United States Patent [19]

Nishimura et al.

[11] Patent Number: 5,031,433

[45] Date of Patent: Jul. 16, 1991

[54] METHOD AND APPARATUS FOR MANUFACTURING A PULLEY

[75] Inventors: Kazuo Nishimura; Kozaburo Tsuchiya, both of Iseaki, Japan

[73] Assignee: Sanden Corporation, Gunma, Japan

[21] Appl. No.: 582,001

[22] Filed: Sep. 13, 1990

Related U.S. Application Data

[63] Continuation of Ser. No. 384,046, Jul. 24, 1989, abandoned, which is a continuation of Ser. No. 192,634, May 11, 1988, abandoned.

[30] Foreign Application Priority Data

May 11, 1987 [JP] Japan ..... 62-112523

[51] Int. Cl.[5] ..... B21D 15/06; B21K 1/42

[52] U.S. Cl. ..... 72/59; 72/62; 29/892.11; 29/892.3

[58] Field of Search ..... 29/892, 892.1, 892.11, 29/892.3; 72/57, 58, 59, 60, 61, 340, 367, 411

[56] References Cited

U.S. PATENT DOCUMENTS

| | | | |
|---|---|---|---|
| 2,598,191 | 5/1952 | Penn | 29/159 R X |
| 3,128,539 | 4/1964 | Brooks, Jr. et al. . | |
| 3,335,590 | 8/1967 | Early . | |
| 3,335,597 | 8/1967 | Gobien | 29/159 R |
| 3,837,200 | 9/1974 | Wolbert . | |
| 3,851,366 | 12/1974 | Jacobs . | |
| 4,050,321 | 9/1977 | Kraft | 29/159 R |
| 4,109,542 | 8/1978 | Kraft . | |
| 4,129,026 | 12/1978 | Pierce et al. . | |
| 4,138,776 | 2/1979 | Oldford | 29/159 R |
| 4,236,289 | 12/1980 | Oldford | 29/159 R |
| 4,287,976 | 5/1981 | Sakai et al. . | |
| 4,297,869 | 11/1981 | Oldford | 29/159 R X |
| 4,314,472 | 2/1982 | Saegusa et al. . | |
| 4,631,946 | 12/1986 | Oda . | |
| 4,669,295 | 6/1987 | Koitabashi . | |
| 4,748,836 | 6/1988 | Hoeboer et al. . | |
| 4,789,380 | 12/1988 | Nishimura . | |
| 4,860,867 | 6/1989 | Nishimura . | |
| 4,899,569 | 2/1989 | Matshushita et al. . | |

FOREIGN PATENT DOCUMENTS

| | | |
|---|---|---|
| 1287490 | 7/1969 | United Kingdom . |
| 1480770 | 7/1977 | United Kingdom . |
| 2019960 | 11/1979 | United Kingdom . |

*Primary Examiner*—Timothy V. Eley
*Assistant Examiner*—Peter Dungba Vo
*Attorney, Agent, or Firm*—Banner, Birch, McKie & Beckett

[57] ABSTRACT

An appratus and method for manufacturing a pulley having a generally V-shaped groove therein is provided. The apparatus includes a press section and a molding section. The starting material for forming the pulley is a ring-shaped workpiece which is preferably composed of a bendable metal. The apparatus clamps the workpiece about a central annular portion thereof. Other parts of the apparatus bend upper and lower annular portions of the workpiece radially outwardly, thereby forming a V-shaped groove. The pulley is formed by a single thrusting motion of the press section. The bottom portion of the V-shaped groove has a uniform thickness which is not thinned by the action of the press.

24 Claims, 6 Drawing Sheets

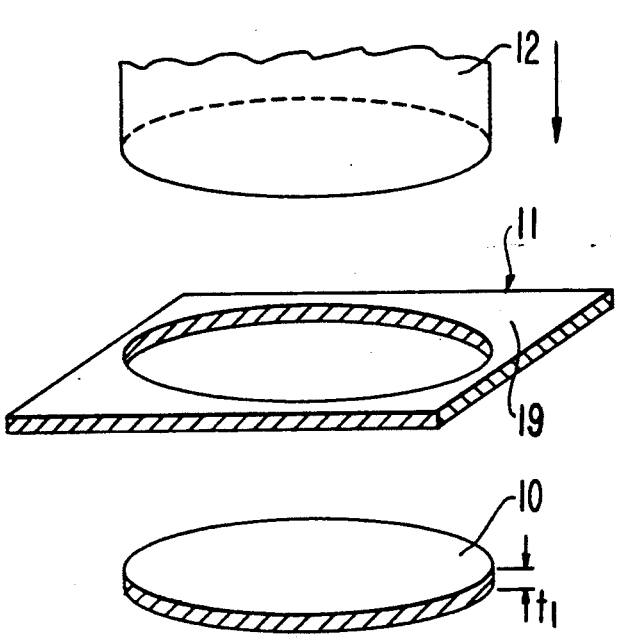
FIG. 1
(PRIOR ART)
FIG. 5
(PRIOR ART)
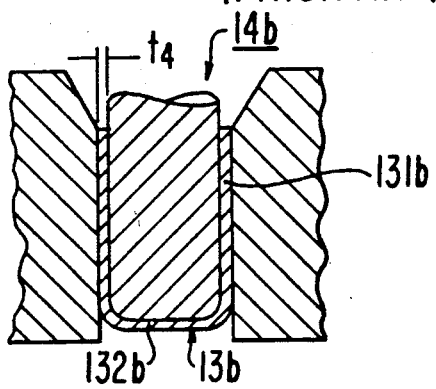
FIG. 2
(PRIOR ART)
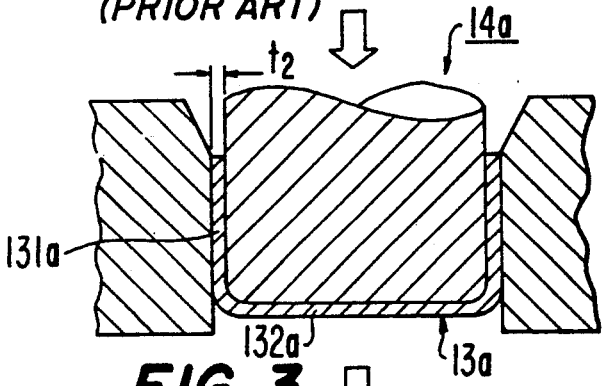
FIG. 6
(PRIOR ART)
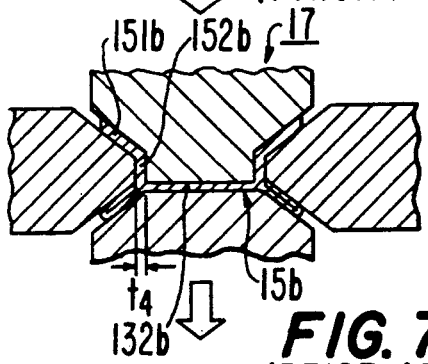
FIG. 3
(PRIOR ART)
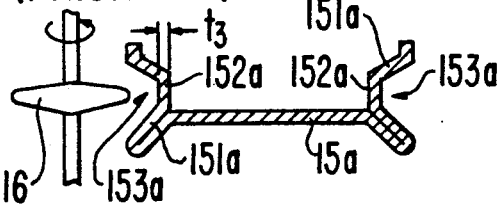
FIG. 4
(PRIOR ART)
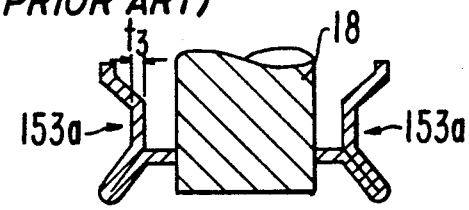
FIG. 7
(PRIOR ART)
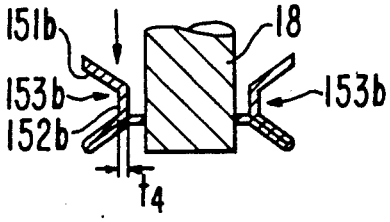

METHOD AND APPARATUS FOR MANUFACTURING A PULLEY

This application is a continuation of application Ser. No. 384,046, filed Jul. 24, 1989, abandoned, which is a continuation of application Ser. No. 192,634, filed May 11, 1988, abandoned.

BACKGROUND OF THE INVENTION

1. Field of the Invention

This invention relates to a method and apparatus for making a pulley which may be used to transmit dynamic power. More particularly, the invention relates to a method and apparatus for making a pulley having a V-shaped groove in an outer surface thereof. Pulleys of this type are typically used with a belt having a trapezoidally-shaped cross section, for example as an electromagnetic clutch of a compressor in an automobile air conditioning system. The pulley made according to the method and apparatus of the present invention has an annular generally V-shaped groove in the outer surface thereof. The groove has a size and shape adapted to accommodate a transmission or other type of belt. The pulley is adapted to be attached, such as by welding, to a rotor or similar rotating device. Pulleys of this type will be referred to hereinafter as a "V-pulley".

2. Description of the Prior Art

Two alternative prior art methods for manufacturing V-pulleys are illustrated in FIGS. 1–4 and FIGS. 1, 5–7, respectively. In both of these prior art methods, a circular plate 10 is initially cut from a metal sheet 11 using a cutting punch 12 as shown in FIG. 1. Referring to the prior art method illustrated in FIGS. 1–4, the circular plate 10 is first formed into a cup 13*a* using a drawing die 14*a*. Cup 13*a* has a bottom portion 132*a* and a cylindrical portion 131*a*. Drawing with the drawing die 14*a* causes some thinning, primarily in the cylindrical portion 131*a* of cup 13*a*. Thus, the thickness $t_2$ of cylindrical portion 131*a* is less than the original thickness $t_1$ of plate 10. In a third manufacturing step, shown in FIG. 3, the cup 13*a* is further shaped by roller 16 which forms a generally V-shaped groove 153*a* in the cylindrical portion 131*a*. The V-shaped groove 153*a* comprises a bottom portion 152*a* and leg portions 151*a*. The action of the shaping roller 16 along the cylindrical portion 131*a* causes further thinning of the sheet material primarily in the vicinity of bottom portion 152*a*. Thus, the thickness $t_3$ of portion 152*a* is less than thickness $t_2$. In the final step of manufacturing, as shown in FIG. 4, a central portion of the V-pulley 15*a* is punched out by cutting punch 18. The V-pulley 15*a* is thus adapted to be mounted on a rotor or other type of rotatable shaft by extending the rotor or shaft into the punched out opening.

An alternate prior art manufacturing method is illustrated in FIGS. 1 and 5–7. In this method, the circular plate 10 is drawn with a drawing die 14*b* as shown in FIG. 5. Similar to the operation illustrated in FIG. 2, the drawing die 14*b* forms circular plate 10 into a cup 13*b* having a bottom portion 132*b* and a cylindrical portion 131*b*. However, the diameter of drawing die 14*b* is less than the diameter of drawing die 14*a*. Drawing with the smaller diameter die 14*b* causes a significant reduction in the thickness of the sheet material. Accordingly, the thickness $t_4$ of cylindrical portion 131*b* is less than either the thickness $t_1$ of the circular plate 10 or the thickness $t_2$ of cylindrical portion 131*a*.

As shown in FIG. 6, cup 13*b* is formed into a V-pulley 15*b* by the press 17. The press 17 forms a generally V-shaped groove 153*b* in the cylindrical portion 131*b*. The V-shaped groove 153*b* includes a bottom portion 152*b* and two leg portions 151*b*. In the last manufacturing step illustrated in FIG. 7, a central portion of the V-pulley 15*b* is cut using a cutting punch 18.

There are several disadvantages to the above-described prior art manufacturing methods. One disadvantage is the waste material 19 which remains after the initial cutting of the circular plate 10. This results in higher material costs.

Another disadvantage to the prior art manufacturing methods is that they require at least four separate manufacturing steps ((1) cutting, (2) drawing, (3) groove shaping and (4) punching) in order to form the V-pulley.

A still further disadvantage of the prior art manufacturing methods is the thinning of the sheet material in the vicinity of the bottom of the V-shaped groove. The bottom of the V-shaped groove must be able to withstand the tension of a belt wrapped around the pulley and carried within the V-shaped groove. Thinning of the bottom portion of the V-shaped groove leads to a reduction in the strength of the pulley which can lead in extreme cases to V-pulley failure.

SUMMARY OF THE INVENTION

It is an object of the present invention to provide a method and apparatus for making a V-pulley in a single manufacturing step and which minimizes the amount of waste material produced.

It is another object of the present invention to provide a method and apparatus for manufacturing a V-pulley having an annular V-shaped groove in an exterior surface thereof, wherein the groove has a bottom portion with a thickness that is uniform and which is not thinned by the process of manufacturing the V-pulley.

These and other important objects are met by the method and apparatus of the present invention. The method comprises clamping a ring-shaped workpiece about a central annular portion thereof to secure said workpiece in a fixed position. An upper annular portion of the workpiece is then bent radially outwardly to form one leg of the V-shaped groove. A lower annular portion of the workpiece is also bent radially outwardly to form the other leg of the V-shaped groove.

The apparatus includes a clamp for securing the ring-shaped workpiece in a fixed position. The clamp engages the workpiece about a central annular portion thereof. Means are provided for bending an upper annular portion of the workpiece radially outwardly to form one leg of the V-shaped groove. Means are also provided for bending a lower annular portion of the workpiece radially outwardly to form the other leg of the V-shaped groove.

A preferred method of making a V-pulley according to the present invention starts with a bendable ring-shaped workpiece having a central annular portion bordered by upper and lower annular portions. The central annular portion of the ring-shaped workpiece is clamped between a mold member extending through the workpiece and a plurality of radially slidable clamping members positioned around the circumference of the central annular portion of the workpiece, thereby securing the workpiece in a fixed position. The upper annular portion of the workpiece is then pressed between mating radially outwardly extending mold surfaces to form a radially outwardly extending leg of the V-shaped groove. The lower annular portion of the workpiece is likewise pressed between mating radially outwardly extending mold surfaces to form another radially outwardly extending leg of the V-shaped groove.

A preferred apparatus for making a V-pulley according to the present invention includes a clamp for securing the central annular portion of the ring-shaped workpiece in a fixed position. The clamp includes a plurality of radially slidable clamping members positioned around the circumference of the central annular portion of the workpiece and a mold member which is insertable through the workpiece. The mold includes outer radially outwardly extending surfaces which are moveable with respect to one another and able to move into a mating relationship. The mating mold surfaces are positioned to bend the upper annular portion of the workpiece radially outwardly to form one leg of the V-shaped groove. Lower radially outwardly extending mold surfaces which are moveable with respect to one another and able to move into a mating relationship are also positioned to bend the lower annular portion of the workpiece radially outwardly to form another leg of the V-shaped groove.

Further objects, features and other aspects of this invention will be better understood from the detailed description of certain embodiments of this invention with reference to the annexed drawings.

BRIEF DESCRIPTION OF THE DRAWINGS

FIG. 1 is a perspective view of a circular plate being cut from a metal sheet by a cutting punch in accordance with the prior art methods of making a V-pulley.

FIGS. 2–4 are sectional side views of apparatus used to make a V-pulley in accordance with one prior art method.

FIGS. 5–7 are sectional side views of apparatus used to make a V-pulley in accordance with another prior art method.

DETAILED DESCRIPTION OF THE INVENTION

Figure 15:
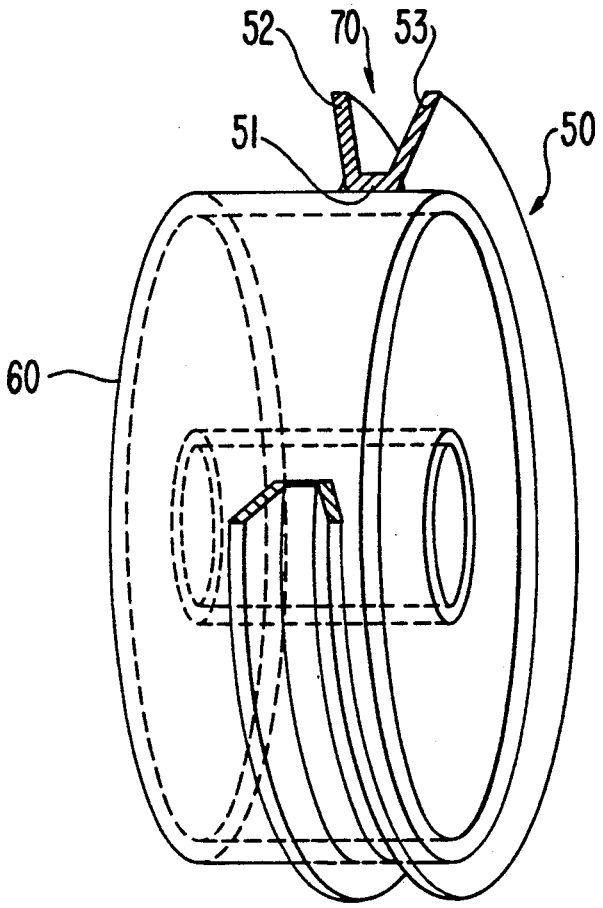
FIG. 15 is a perspective view, with parts shown in phantom, of a V-shaped pulley made in accordance with the method and apparatus of the present invention, mounted on a cylindrical rotor.

The V-pulley made in accordance with the method and apparatus of the present invention is shown in FIG. 15 and designated by the numeral 50. V-pulley 50 consists of a bottom portion 51 having a substantially uniform thickness and leg portions 52, 53. As will be readily appreciated, a belt having a trapezoidal cross section is adapted to fit within the V-shaped groove 70. Groove 70 has a generally V-shaped cross-section. Similar cross-sectional shapes are encompassed by the terms "V-shaped" and "generally V-shaped" as used herein. The pulley 50 is shown mounted on a rotor 60.

Figure 12:
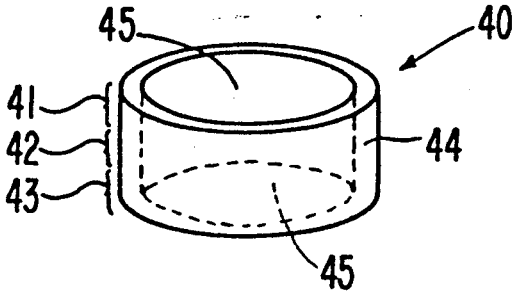
FIG. 12 is a perspective view, with parts shown in phantom, of a ring-shaped workpiece used to make the V-pulley according to the method of the present invention.

Unlike the prior art methods for manufacturing V-shaped pulleys which started with a circular plate 10, the method of the present invention starts with a ring-shaped workpiece 40 as shown in FIG. 12. The workpiece 40 has a cylindrical wall 44 of substantially uniform thickness and two open ends 45. The workpiece 40 may be formed for example by cutting a length of pipe having an appropriate diameter and wall thickness. The workpiece 40 is preferably formed from a bendable metal such as steel or aluminum and typically has a wall thickness on the order of about 1 to 2 mm. However, the present invention is not limited to any particular material or wall thickness. As can be readily appreciated by those skilled in the art, the use of the ring-shaped workpiece 40 as a starting material virtually eliminates waste or scrap material which was a problem in the prior art methods.

Workpiece 40 can be imagined as having three annular portions including an upper annular portion 41, a central annular portion 42 and a lower annular portion 43. In accordance with the method of the present invention, the middle annular portion 42 becomes the bottom portion 51 of the V-pulley 50. Likewise, the upper and lower annular portions 41, 43 become the leg portions 52, 53 of the V-pulley 50. Although the present invention is not limited to any particular dimensions or ratios for the lengths of annular portions 41, 42, and 43, typically the annular portions 41, 43 will have a length that is about twice as long as the length of annular portion 42 (i.e., the lengths of leg portions 52, 53 are typically up to about twice as long as the length of the bottom portion 51 of the groove 70).

The method and apparatus for making the V-pulley 50 will be explained with reference to FIGS. 8–11 which illustrates one half of a symmetrical apparatus in different stages of the one step manufacturing operation. The apparatus 1 for manufacturing a V-pulley in accordance with the present invention includes a press section 20 and a molding section 30. Initially, the two sections 20, 30 are spaced apart in order to allow a ring-shaped workpiece 40 to be mounted in the molding section 30.

The press section 20 includes a cup-shaped guide 21 and an upper mold member 22. The upper mold member 22 is fixedly attached to guide 21 within a circular recess 212. The upper mold member 22 has a bottom surface 224 and a vertical cylindrical surface 223. The upper portion of mold member 22 has a radial projection 221 with an angled and radially outwardly extending surface 222.

Press section 20 is adapted to be thrust downwardly into engagement with the molding section 30. The vertical movement of press section 20 may be controlled by a hydraulic pump, a crank mechanism or similar device (not shown).

Figure 8:
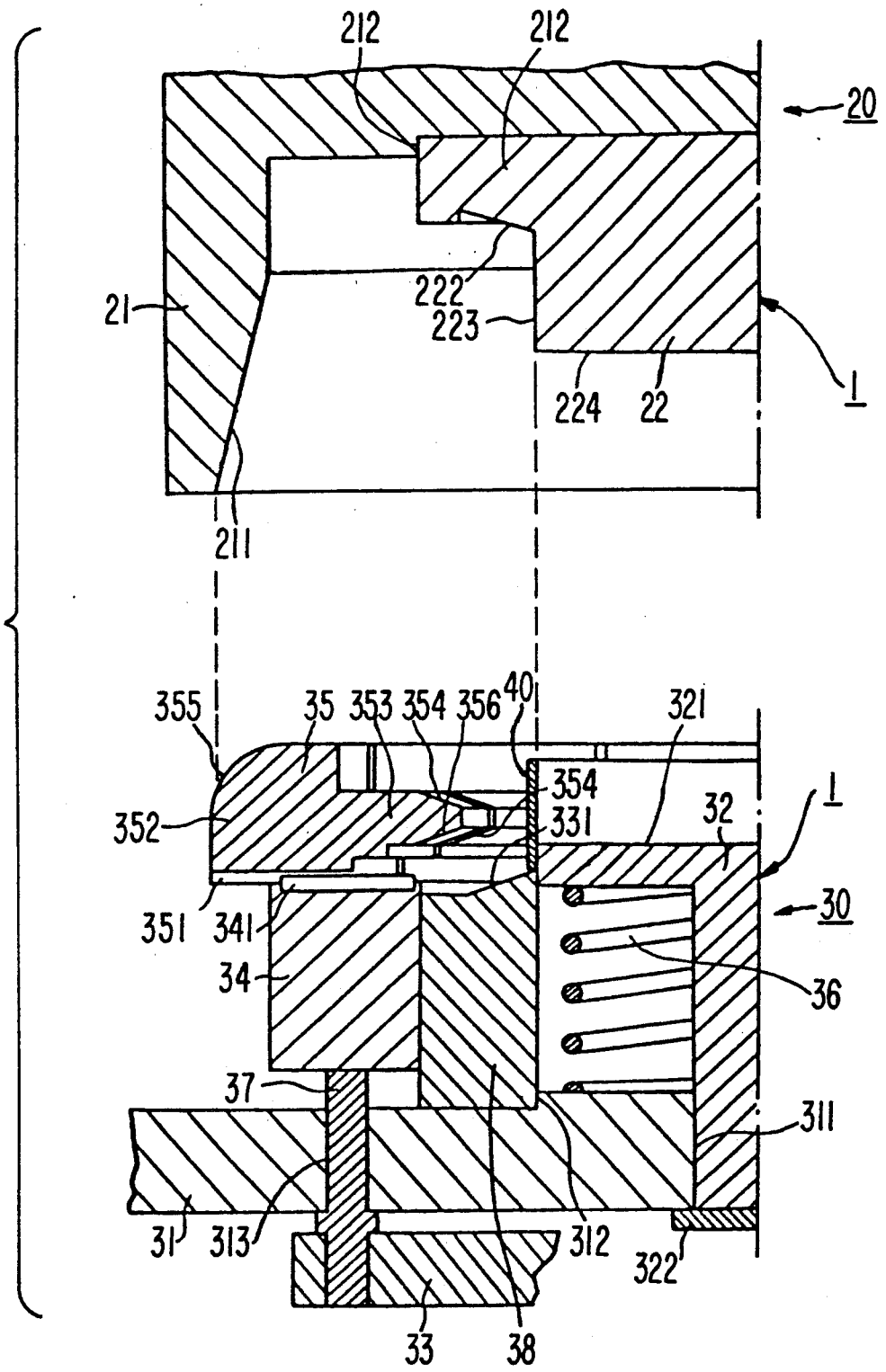
FIG. 8 is a side sectional view showing one half of an apparatus for manufacturing a V-pulley in accordance with the present invention.

The molding section 30 includes a stationary base 31 having a central opening 311 and a plurality of openings 313 (only one shown), arranged in a circle, therein. Slidably disposed within opening 311 is a platform 32 having a generally T-shaped cross section. The platform 32 has an upper surface 321 which is adapted to abut against surface 224 when the press section 20 is lowered into engagement with the molding section 30. Platform 32 is biased upwardly with a spring 36. A stopper 322 is provided to limit the upward movement of platform 32. The upper portion of platform 32 has a cylindrical shape with a diameter that is substantially equal to the inner diameter of workpiece 40. Thus, the workpiece 40 is initially mounted on the upper portion of platform 32 as illustrated in FIG. 8. Platform 32 is also slidably engaged with a lower mold member 33 having an angled and radially outwardly extending surface 331. Lower mold member 33 has a generally annular shape and surrounds ridge 312. Member 33 is fixedly attached to base 31 by appropriate fastening means (not shown). An annular member 34 is positioned radially outward from lower mold member 33 and in sliding engagement therewith. Annular member 34 is supported on a plurality of plungers 37 (only one plunger 37 is shown in the Figures), each plunger 37 passing through an opening 313 in base 31. The plungers 37 are connected with a conventional hydraulic biasing means 38. The hydraulic biasing means 38 exerts an upward pressure on the plungers 37 which in turn exert upward pressure on the annular member 34.

Figure 13:
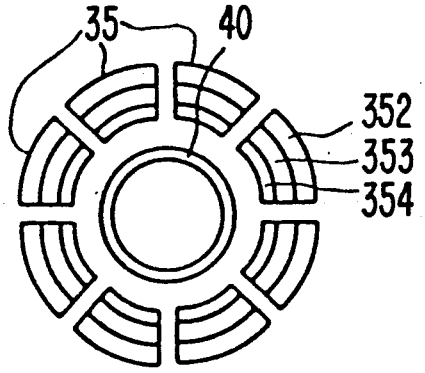
FIG. 13 is a top view of a ring-shaped workpiece 40 and a clamping apparatus 35, the clamping apparatus being in an open condition.
Figure 14:
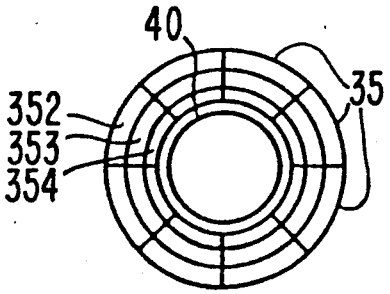
FIG. 14 is a top view of the workpiece 40 and the clamping apparatus 35 shown in FIG. 13, the clamping apparatus being in a closed condition.

Positioned on top of annular member 34 is a clamping member 35. A plurality of clamping members 35 surround the workpiece 40 as best shown in FIGS. 13 and 14. Each clamping member 35 is radially slidable by reason of a key 341 and a groove 351. Key 341 is fixedly attached to the upper portion of annular member 34 and extends in a radial direction. Groove 351 in the clamping member 35 also extends in a radial direction and slidably engages with key 341. Thus, the clamping members 35 may be moved in a radial direction with respect to annular member 34. FIG. 13 shows the plurality of clamping members 35 surrounding the workpiece 40 with each clamping member 35 being in a radially outward position (similar to the position shown in FIG. 8). FIG. 14 shows the clamping members 35 in a radially inward position surrounding and clamping against the exterior circumference of workpiece 40 (similar to the position shown in FIGS. 9–11). Each clamping member 35 comprises an outer portion 352 and an inner portion 353. The inner portion 353 has angled and radially outwardly extending surfaces 354, 356. The outer portion 352 has a rounded surface 355 which is adapted to engage the angled surface 211 of guide 21 when the press section 20 is lowered into engagement with the molding section 30.

Figure 9:
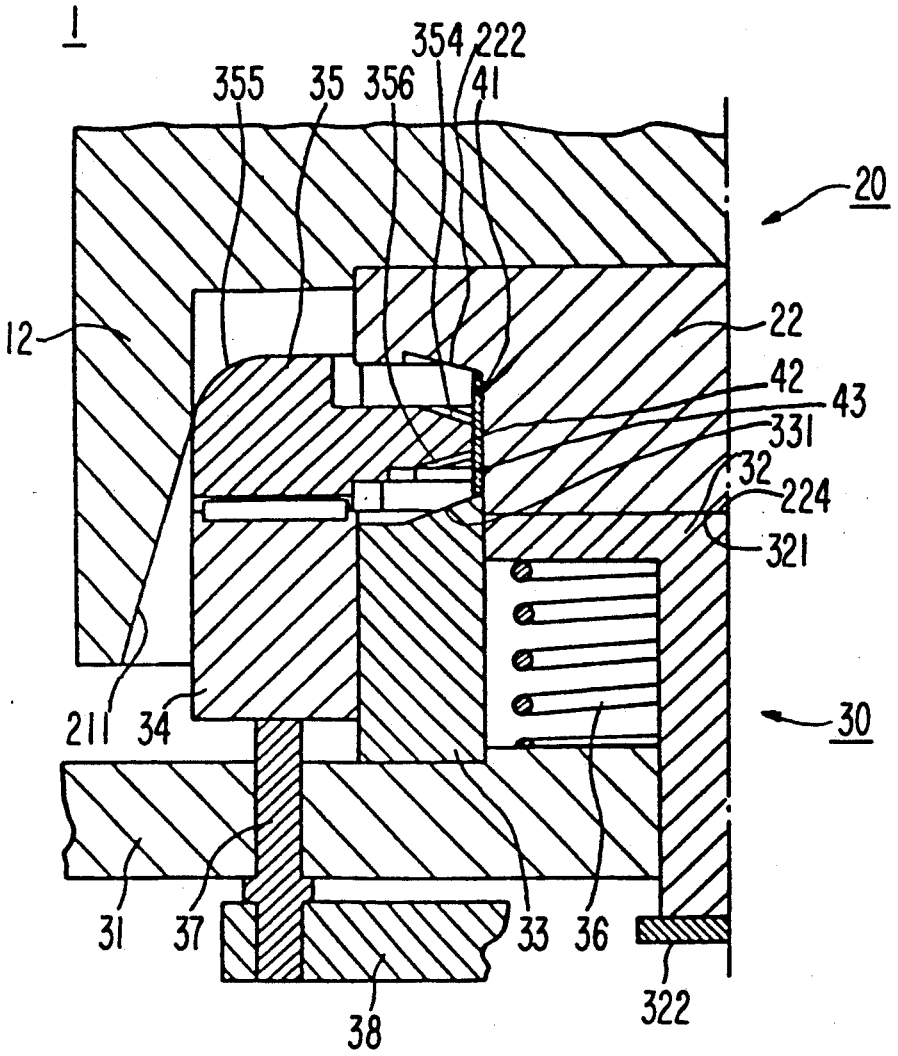
FIGS. 9–11 are side sectional views of the apparatus shown in FIG. 8 in successive stages of the manufacturing process.

After mounting the ring-shaped workpiece 40 on the platform 32, as shown in FIG. 8, the appropriate hydraulic or other means are activated to lower the press section 20 into engagement with the molding section 30. FIG. 9 illustrates an intermediate position of the sections 20, 30 in the downward path of press section 20. In this position, the surface 355 has encountered the angled surface 211 causing the clamping members 35 to be forced radially inwardly into clamping engagement with the central annular portion 42 of the workpiece 40. Simultaneously, the bottom surface 224 of the upper mold member 22 has engaged the top surface 321 of platform 32 causing the platform 32 to be moved downwardly, thereby compressing the spring 36. In this position, the cylindrically-shaped mold member 22 extends through the interior of the ring-shaped workpiece 40. In the position shown in FIG. 9, the central annular portion 42 of workpiece 40 becomes fixedly clamped between the clamping members 35 and the mold member 22. In this position, the upper and lower annular portions 41, 43 of the ring-shaped workpiece 40 have just begun to abut against the angled surfaces 222 and 331, respectively.

Figure 10:
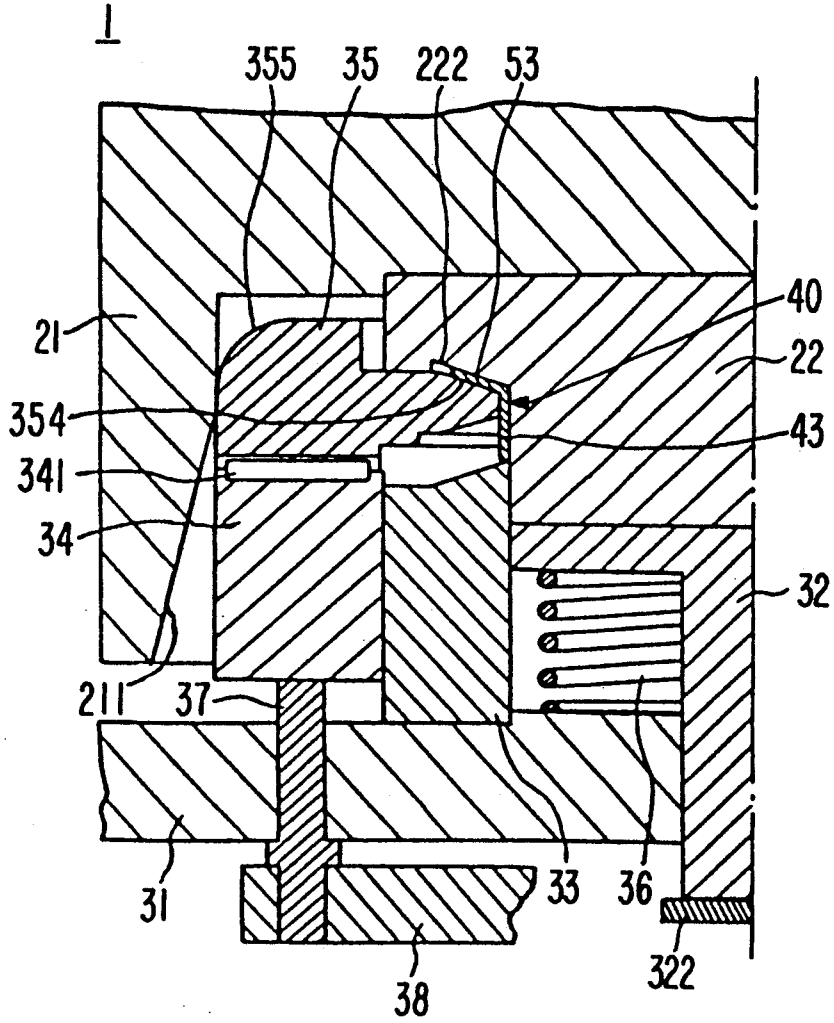

The press section 20 continues to move downwardly into the position shown in FIG. 10. In this position, the spring 36 is somewhat more compressed than it was in the position shown in FIG. 9. This causes the upper annular portion 41 of the workpiece 40 to be bent radially outwardly between the now mating surfaces 222, 354. Once bent into this position, the upper annular portion 41 becomes the outwardly extending leg portion 53 of the V-shaped groove 70. Those skilled in the art will appreciate that this can be easily accomplished by adjusting the biasing forces of the spring 36 and the hydraulic biasing means 38. The biasing force of the hydraulic means 38 should be greater than that of spring 36 to ensure that the upper annular portion 41 is bent before the lower annular portion 43.

Figure 11:
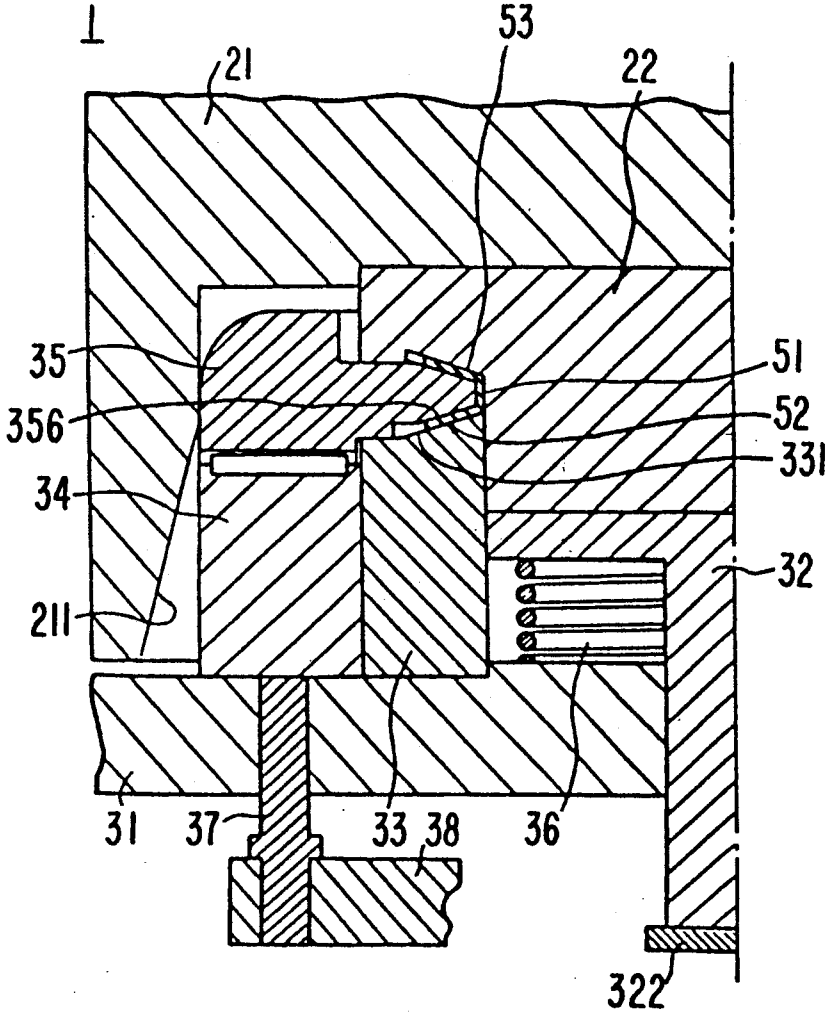

The press section 20 continues to move downwardly from the position illustrated in FIG. 10 to that illustrated in FIG. 11, which represents the downward-most position of press section 20. The final downward movement of press section 20 causes the lower annular portion 43 of workpiece 40 to be bent between the angled surfaces 331, 356. In the position shown in FIG. 11, lower annular portion 43 is pressed between the now mating surfaces 331, 356. Once bent into this position, the lower annular portion 43 becomes the radially outwardly extending leg portion 52 of the V-shaped groove 70. The portion of the workpiece 40 remaining clamped between clamping means 35 and upper mold member 22 becomes bottom portion 51 of the V-pulley 50.

The above-described apparatus and manufacturing method provides several advantages over the prior art methods of manufacturing a V-pulley. A primary advantage of the above-described method is that the V-pulley is formed in a single manufacturing step, and more particularly by a single thrust of the press section 20 onto the molding section 30.

Another advantage, as mentioned hereinbefore, is that the use of the ring-shaped workpiece 40 as the starting material substantially eliminates the scrap material produced by the prior art methods in cutting a circular plate from a rectangular sheet of material.

Another important advantage of the method and apparatus of the present invention is that the manufacturing operation causes no thinning of the bottom portion 51 of the V-shaped groove 70. This is due primarily to the fact that the central annular portion 42 (which portion becomes the bottom portion 51 of the V-shaped groove 70) is compressively held by the clamping members 35 and the mold member 22 during the manufacturing operation. Thus, the thickness of bottom portion 51 is uniform along its length and width and furthermore, is substantially equal to the original wall thickness of the workpiece 40.

Although a preferred embodiment of the invention has been described in considerable detail, those skilled in the art will appreciate that this is only one embodiment of the invention and that other variations and modifications may be made thereto all falling within the scope of the present invention as defined by the appended claims.

We claim:

1. A method of making a V-pulley having an annular generally V-shaped groove and an outer surface thereof, from a bendable ring-shaped workpiece having a central annular portion bordered by upper and lower annular portions, comprising the steps of:

(a) clamping at least eight clamping members against a central annular portion of a ring-shaped workpiece to hold said workpiece central annular portion in a fixed position;

(b) bending an upper annular portion of a workpiece to form one substantially finished leg of the V-shaped groove in one step; and (c) bending a lower annular portion of the workpiece to form another substantially finished leg of the V-shaped groove in one step;

wherein the clamping against the central annular portion of the workpiece is performed during both of the upper annular portion and the lower annular portion bending steps and the portion of the workpiece clamped becomes a bottom portion of the V-pulley.

2. The method of claim 1, wherein said workpiece is composed of bendable metal.

3. The method of claim 1, wherein said bending of the upper annular portion step further comprises pressing said upper annular portion between mating angled and radially outwardly extending surfaces in a mold.

4. The method of claim 1, wherein said bending of the lower annular portion step further comprises pressing said lower annular portion between mating radially outwardly extending surfaces in a mold.

5. The method of claim 1, wherein the steps are performed in the sequence set forth.

6. The method of claim 1, wherein the step of bending the upper annular portion of the workpiece to form a substantially finished leg is performed with a single pair of upper mating mold surfaces and the step of bending the lower annular portion of the workpiece to form another substantially finished leg is performed with a single pair of lower mating mold surfaces.

7. A method of making a V-pulley having an annular generally V-shaped groove in an outer surface thereof, from a bendable ring-shaped workpiece having a central annular portion bordered by upper and lower annular portions, comprising the steps of:

(a) clamping against a central annular portion of a ring-shaped workpiece to hold said workpiece central annular portion in a fixed position, wherein said clamping step includes:

inserting a cylindrically-shaped mold member entirely through the interior of the workpiece, and sliding at least eight clamping members radially inwardly against an outer circumference of the central annular portion of the workpiece, thereby clamping the central annular portion therebetween;

(b) bending an upper annular portion of a workpiece to form one substantially finished leg of the V-shaped groove in one step; and (c) bending a lower annular portion of the workpiece to form another substantially finished leg of the V-shaped groove in one step, wherein the portion of the workpiece clamped becomes a bottom portion of the V-pulley.

8. A method of making a V-pulley having a generally annular V-shaped groove in an outer surface thereof, from a bendable ring-shaped workpiece having a central annular portion bordered by upper and lower annular portions, comprising the steps of:

(a) clamping the central annular portion of the ring-shaped workpiece to a mold between a mold member extending through an interior of the workpiece and at least eight radially slidable clamping members positioned against an outer circumference of the central annular portion, thereby holding said workpiece central annular portion in a fixed position;

(b) bending the upper annular portion of the workpiece between a pair of upper mating radially outwardly extending mold surfaces which are movable with respect to one another to form one substantially finished radially outwardly extending leg of the V-shaped groove; and (c) bending the lower annular portion of the workpiece between a pair of lower mating radially outwardly extending mold surfaces which are movable with respect to one another to form another substantially finished radially outwardly extending leg of the V-shaped groove.

9. A method of claim 8, wherein closing the mold causes the mold member to extend entirely through the ring-shaped workpiece.

10. The method of claim 8, wherein closing the mold causes the upper radially extending surfaces to mate and the lower radially extending surfaces to mate.

11. The method of claim 8, wherein the steps are performed in the sequence set forth.

12. A method of making a V-pulley having an annular generally V-shaped groove in an outer surface thereof, from a bendable ring-shaped workpiece having a central annular portion bordered by upper and lower annular portions, comprising the step of:

clamping the central annular portion of the ring-shaped workpiece in a mold between a mold member extending through the workpiece and at least eight radially slidable clamping members positioned around the circumference of the central annular portion, thereby holding said workpiece central annular portion in a fixed position;

bending the upper annular portion of the workpiece between upper mating radially outwardly extending mold surfaces which are movable with respect to one another to form one radially outwardly extending leg of the V-shaped groove; and bending the lower annular portion of the workpiece between mating radially outwardly extending mold surfaces which are movable with respect to one another to form another radially outwardly extending leg of the V-shaped groove, wherein closing of the mold causes the radially slidable clamping members to slide radially inwardly and compressively engage the central annular portion of the workpiece.

13. An apparatus for making a V-pulley having an annular generally V-shaped groove in an outer surface thereof, from a bendable ring-shaped workpiece having a central annular portion bordered by upper and lower annular portions, comprising:

(a) a clamp, including at least eight clamping members for securing a ring-shaped workpiece in a fixed position, the clamp engaging the workpiece central annular portion thereof;

(b) means for bending an upper annular portion of the workpiece radially outwardly to form one substantially finished leg of the V-shaped groove in one step; and (c) means for bending a lower annular portion of the workpiece radially outwardly to form another substantially finished leg of the V-shaped groove in one step;

wherein said clamp engages the workpiece central annular portion when the upper annular portion and the lower annular portion bending means are forming the substantially finished legs of the V-shaped groove and the portion of the workpiece clamped becomes a bottom portion of the V-pulley.

14. The apparatus of claim 13, wherein said workpiece is composed of bendable metal.

15. The apparatus of claim 13, wherein said means for bending the upper annular portion includes mating radially outwardly extending mold surfaces which are movable with respect to one another.

16. The apparatus of claim 13, wherein said means for bending the lower annular portion includes mating radially outwardly extending mold surfaces which are movable with respect to one another.

17. An apparatus for making a V-pulley having an annular generally V-shaped groove in an outer surface thereof, from a bendable ring-shaped workpiece having a central annular portion bordered by upper and lower annular portions, comprising:

(a) a clamp for securing a ring-shaped workpiece in a fixed position, the clamp engaging the workpiece central annular portion thereof, wherein said clamp includes at least eight radially slidable clamping members and a vertically movable mold member adapted to be inserted entirely through the ring-shaped workpiece;

(b) means for bending an upper annular portion of the workpiece radially outwardly to form one substantially finished leg of the V-shaped groove in one step; and (c) means for bending a lower annular portion of the workpiece radially outwardly to form another substantially finished leg of the V-shaped groove in one step, wherein the portion of the workpiece clamped becomes a bottom portion of the V-pulley.

18. The apparatus of claim 17, wherein said vertically movable mold member has an outer diameter which is of a size for being substantially disposed against and disposed entirely through an inner diameter of the ring-shaped workpiece.

19. An apparatus for making a V-pulley having an annular generally V-shaped groove in an outer surface thereof, from a bendable ring-shaped workpiece having a central annular portion bordered by upper and lower annular portions, comprising;

(a) a mold having a clamp for securing the central annular portion of the ring-shaped workpiece in a fixed position, the clamp having at least eight radially slidable clamping members for being positioned against an outer circumference of the central annular portion of the workpiece and a mold member which is insertable through an interior of the workpiece;

(b) a pair of mating radially outwardly extending upper mold surfaces which are movable with respect to one another, said mating upper mold surfaces being positioned for bending the upper annular portion of the workpiece radially outwardly to form one substantially finished leg of the V-shaped groove; and (c) a pair of mating radially outwardly extending lower mold surfaces which are movable with respect to one another, said mating lower mold surfaces being positioned for bending the lower annular portion of the workpiece radially outwardly to form another substantially finished leg of the V-shaped groove.

20. The apparatus of claim 19, wherein the mold member is cylindrically shaped and has a diameter which is of a size for being substantially disposed against and disposed entirely through an inner diameter of the ring-shaped workpiece, the mold member being insertable through the workpiece upon closing the mold.

21. The apparatus of claim 19, wherein the upper radially extending mold surfaces are mated by closing the mold.

22. The apparatus of claim 19, wherein the lower radially extending mold surfaces are mated by closing the mold.

23. An apparatus for making a V-pulley having an annular generally V-shaped groove in an outer surface thereof from a bendable ring-shaped workpiece having a central annular portion bordered by upper and lower annular portions, comprising;

a mold having a clamp for securing the central annular portion of the ring-shaped workpiece in a fixed position, the clamp having at least eight radially slidable clamping members for being positioned against an outer circumference of the central annular portion of the workpiece and a mold member which is insertable through the workpiece;

mating radially outwardly extending upper mold surfaces which are movable with respect to one another, said mating upper mold surfaces being positioned for bending the upper annular portion of the workpiece radially outwardly to form one leg of the V-shaped groove; and mating radially outwardly extending lower mold surfaces which are movable with respect to one another, said mating lower mold surfaces being positioned for bending the lower annular portion of the workpiece radially outwardly to form another leg of the V-shaped groove, wherein the radially slidable clamping members slide radially inwardly upon closing the mold.

24. An apparatus for making a V-pulley having an annular generally V-shaped groove in an outer surface thereof, from a bendable ring-shaped workpiece having a central annular portion bordered by upper and lower annular portions, comprising:

a molding section including:

at least eight means for engaging portions of an outer circumference of a central annular portion of a workpiece having:

an upper mold surface; and a lower mold surface; and a lower mold member being movable relative to the lower mold surface of the engaging means; and a press section, insertable into the molding section, including:

means for forcing the workpiece engaging means against portions of the outer circumference of the central annular portion of the workpiece when the press section is inserted into the molding section;

means, being movable, for extending through an inner diameter of a workpiece when the press section is inserted into the molding section; and an upper mold member being movable relative to the upper mold surface of the molding section workpiece engaging means so that, upon insertion of the press section into the molding section, the molding section workpiece engaging means upper and lower mold surfaces cooperate with the upper and lower mold surfaces to form substantially finished legs of the V-shaped groove.

* * * * *